US008871038B2

(12) United States Patent
Suzuki et al.

(10) Patent No.: US 8,871,038 B2
(45) Date of Patent: Oct. 28, 2014

(54) TINNED STEEL SHEET AND METHOD FOR PRODUCING THE SAME

(75) Inventors: Takeshi Suzuki, Tokyo (JP); Norihiko Nakamura, Tokyo (JP); Hiroki Iwasa, Tokyo (JP)

(73) Assignee: JFE Steel Corporation (JP)

( * ) Notice: Subject to any disclaimer, the term of this patent is extended or adjusted under 35 U.S.C. 154(b) by 373 days.

(21) Appl. No.: 13/002,842

(22) PCT Filed: Jul. 2, 2009

(86) PCT No.: PCT/JP2009/062489

§ 371 (c)(1),
(2), (4) Date: Jan. 6, 2011

(87) PCT Pub. No.: WO2010/005041

PCT Pub. Date: Jan. 14, 2010

(65) Prior Publication Data

US 2011/0180185 A1 Jul. 28, 2011

(30) Foreign Application Priority Data

Jul. 10, 2008 (JP) ..... 2008-179679

(51) Int. Cl.
*C23C 22/07* (2006.01)
*C23C 22/58* (2006.01)

(52) U.S. Cl.
USPC ..... 148/253; 148/255; 148/279; 106/14.12; 428/432; 428/428

(58) Field of Classification Search
CPC ..... C23C 22/07; C23C 22/08; C23C 22/20; C23C 2222/20
USPC ..... 148/253–263; 106/14.12
See application file for complete search history.

(56) References Cited

U.S. PATENT DOCUMENTS

| | | | | | |
|---|---|---|---|---|---|
| 3,912,601 | A | * | 10/1975 | Asano et al. | 205/318 |
| 4,306,917 | A | | 12/1981 | Oda et al. | |
| 2003/0129442 | A1 | * | 7/2003 | Shigekuni et al. | 428/648 |

FOREIGN PATENT DOCUMENTS

| | | | | | |
|---|---|---|---|---|---|
| JP | 49-28539 | A | | 3/1974 | |
| JP | 55-24516 | B | | 6/1980 | |
| JP | 55-24516 | B2 | | 6/1980 | |
| JP | 56-096081 | A | | 8/1981 | |
| JP | 59-047396 | A | | 3/1984 | |
| JP | 2001-316851 | A | | 11/2001 | |
| JP | 2003-239084 | A | | 8/2003 | |
| JP | 2005-029808 | A | | 2/2005 | |
| JP | 2007-239004 | | * | 9/2007 | C23C 22/20 |
| JP | 2007-239004 | A | | 9/2007 | |
| JP | 2007-239091 | A | | 9/2007 | |
| JP | 2008-230117 | | * | 10/2008 | B32B 15/09 |

* cited by examiner

*Primary Examiner* — Lois Zheng
(74) *Attorney, Agent, or Firm* — DLA Piper LLP (US)

(57) ABSTRACT

A tinned steel sheet includes an Sn-containing plating layer disposed on at least one surface of a steel sheet and in which mass per unit area of Sn is 0.05 to 20 g/m$^2$; a first chemical conversion coating disposed on the Sn-containing plating layer and contains P and Sn, and in which mass per unit area of P is 0.3 to 10 mg/m$^2$; a second chemical conversion coating disposed on the first chemical conversion coating and contains P and Al, and in which mass per unit area of P is 1.2 to 10 mg/m$^2$ and mass per unit area of Al is 0.24 to 8.7 mg/m$^2$; and a silane coupling agent-treating layer formed with the silane coupling agent disposed on the second chemical conversion coating and has a mass per unit area of Si of 0.10 to 100 mg/m$^2$.

6 Claims, No Drawings

TINNED STEEL SHEET AND METHOD FOR PRODUCING THE SAME

RELATED APPLICATIONS

This is a §371 of International Application No. PCT/JP2009/062489, with an international filing date of Jul. 2, 2009 (WO 2010/005041 A1, published Jan. 14, 2010), which is based on Japanese Patent Application No. 2008-179679, filed Jul. 10, 2008, the subject matter of which is incorporated by reference.

TECHNICAL FIELD

This disclosure relates to tinned steel sheets used for DI cans, food cans, beverage cans, and other cans and particularly relates to a tinned steel sheet having a chemical conversion coating, disposed thereon, containing no chromium (Cr) and a method for producing such a tinned steel sheet.

BACKGROUND

Tinned steel sheets referred to as "tinplate" have been widely used as surface-treated steel sheets for cans. In those tinned steel sheets, chromate coatings are formed on tin plating layers by chromating such that steel sheets are immersed in aqueous solutions containing a hexavalent chromium compound such as bichromic acid or are electrolyzed in the aqueous solutions. This is because the formation of the chromate coatings prevents the surface oxidation of the tin plating layers, which are likely to be oxidized during long-term storage, to suppress the deterioration of appearance (yellowing) and also prevents cohesive failure due to the growth of tin (Sn) oxide coatings to secure the adhesion (hereinafter simply referred to as "paint adhesion") with organic resins such as paints in the case of painting the tinned steel sheets.

In light of recent environmental issues, efforts to restrict the use of Cr are being made in every field. For tinned steel sheets for cans, several chemical conversion techniques alternative to chromating have been proposed.

For example, Japanese Examined Patent Application Publication No. 55-24516 discloses a method for surface-treating a tinned steel sheet. In that method, a chemical conversion coating is formed such that the tinned steel sheet is subjected to direct-current electrolyzing in a phosphate solution using the tinned steel sheet as a cathode. Japanese Examined Patent Application Publication No. 58-41352 discloses a chemical conversion solution which contains phosphoric ions, tin ions, and one or more of a chlorate and a bromate and which has a pH of 3 to 6. Japanese Unexamined Patent Application Publication No. 49-28539 discloses a method for surface-treating tinplate. In that method, one or more of calcium phosphate, magnesium phosphate, and aluminum phosphate are applied to tinplate to form a coating with a thickness corresponding to 15 $\mu g/cm^2$ or less. Japanese Unexamined Patent Application Publication No. 2005-29808 discloses a surface-treated steel sheet for containers. In the surface-treated steel sheet, an iron-nickel (Fe—Ni) diffusion layer, an Ni layer, an Ni—Sn alloy layer, and a non-alloyed Sn layer are arranged on a surface of a steel sheet in that order and a phosphoric acid coating having a mass per unit area of 1 to 100 $mg/m^2$ in terms of phosphorus (P) is disposed on the non-alloyed Sn layer.

The chemical conversion coatings disclosed in JP '516, JP '352, JP '539 and JP '808 are less capable of suppressing the deterioration of appearance and reduction of paint adhesion due to the surface oxidation of tin plating layers when compared to conventional chromate coatings.

Japanese Unexamined Patent Application Publication No. 2007-239091 discloses a method for producing a tinned steel sheet. In that method, after a steel sheet is tinned, a chemical conversion coating is then formed such that the steel sheet is immersed in a chemical conversion solution containing tin ions and phosphoric ions or cathodically electrolyzed in the chemical conversion solution and is then heated to a temperature of 60° C. to 200° C. The chemical conversion coating can suppress the deterioration of appearance and the reduction of paint adhesion due to the surface oxidation of a tin plating layer equally to or better than conventional chromate coatings.

The method disclosed in JP '091 has the problem that a heating unit used subsequently to chemical conversion is necessary and therefore the cost of chemical conversion is high.

It could therefore be helpful to provide a tinned steel sheet which can suppress the deterioration of appearance and reduction of paint adhesion due to surface oxidation of a tin plating layer without using Cr and which can be subjected to chemical conversion at low cost and to provide a method for producing such a tinned steel sheet.

SUMMARY

We conducted intensive studies on tinned steel sheets which can suppress the deterioration of appearance and reduction of paint adhesion due to the surface oxidation of tin plating layers without using Cr and which can be subjected to chemical conversion at low cost. As a result, we found that the following sheet can suppress the deterioration of appearance and reduction of paint adhesion without heating subsequently to chemical conversion: a tinned steel sheet including an Sn-containing plating layer disposed on a steel sheet, a first chemical conversion coating disposed on the Sn-containing plating layer and which contains P and Sn, a second chemical conversion coating disposed on the first chemical conversion coating and which contains P and aluminum (Al), and a silane coupling agent-treating layer disposed on the second chemical conversion coating.

We thus provide a tinned steel sheet including an Sn-containing plating layer disposed on at least one surface of a steel sheet and in which the mass per unit area of Sn is 0.05 to 20 $g/m^2$; a first chemical conversion coating disposed on the Sn-containing plating layer, which contains P and Sn, and in which the mass per unit area of P is 0.3 to 10 $mg/m^2$; a second chemical conversion coating disposed on the first chemical conversion coating, which contains P and Al, and in which the mass per unit area of P is 1.2 to 10 $mg/m^2$ and the mass per unit area of Al is 0.24 to 8.7 $mg/m^2$; and a silane coupling agent-treating layer formed with the silane coupling agent, disposed on the second chemical conversion coating and in which the mass per unit area of Si is 0.10 to 100 $mg/m^2$.

The silane coupling agent-treating layer is preferably a treating layer derived from N-2-(aminoethyl)-3-aminopropyltrimethoxysilane or 3-(2-aminoethyl)-aminopropyltrimethoxysilane.

A tinned steel sheet can be produced by a tinned steel sheet-producing method including forming an Sn-containing plating layer on at least one surface of a steel sheet such that the mass per unit area of Sn is 0.05 to 20 $g/m^2$; immersing or cathodically electrolyzing the steel sheet in a chemical conversion solution containing tetravalent tin ions and phosphate ions; immersing or cathodically electrolyzing the steel sheet in a chemical conversion solution which contains 5 to 200 g/L of aluminum phosphate monobasic and which has a pH of 1.5 to 2.4; drying the steel sheet; and then forming a silane coupling agent-treating layer such that the mass per unit area of Si is 0.10 to 100 mg/m$^2$.

In the producing method, drying is preferably performed at a temperature of lower than 60° C.

The silane coupling agent-treating layer is preferably formed using an aqueous solution containing is N-2-(aminoethyl)-3-aminopropyltrimethoxysilane or 3-(2-aminoethyl)-aminopropyltrimethoxysilane.

The following sheet can thus be produced: a tinned steel sheet which can suppress the deterioration of appearance and reduction of paint adhesion due to surface oxidation of a tin plating layer without using Cr and which can be subjected to chemical conversion at low cost without using a specific heating unit. The tinned steel sheet is suitable for welded beverage cans, two-piece cans, and other cans, which are required to have particularly high paint adhesion. A chemical conversion coating of the tinned steel sheet can be formed at a high line speed of 300 m/minute or more as is formed by current chromating.

DETAILED DESCRIPTION

A tinned steel sheet includes, in series, an Sn-containing plating layer disposed on at least one surface of a cold-rolled steel sheet, made of low-carbon steel or ultra-low carbon steel, for general cans; a first chemical conversion coating containing P and Sn; a second chemical conversion coating containing P and Al; and a silane coupling agent-treating layer. The tinned steel sheet is described below in detail.

(1) Sn-Containing Plating Layer

The steel sheet includes the Sn-containing plating layer disposed on at least one surface thereof to have corrosion resistance. The mass per unit area of Sn needs to be 0.05 to 20 g/m$^2$. This is because when the mass per unit area thereof is less than 0.05 g/m$^2$ or greater than 20 g/m$^2$, the plating layer is likely to have low corrosion resistance or has an increased thickness to cause an increase in cost, respectively. The mass per unit area of Sn can be determined by coulometry or X-ray fluorescence surface analysis.

The Sn-containing plating layer is not particularly limited and is preferably a plating layer (hereinafter referred to as the "Sn layer") including a Sn layer; a plating layer (hereinafter referred to as the "Fe—Sn/Sn layer") having a two-layer structure including an Fe—Sn layer and a Sn layer deposited thereon; a plating layer (hereinafter referred to as the "Fe—Sn—Ni/Sn layer") having a two-layer structure including an Fe—Sn—Ni layer and a Sn layer deposited thereon; or a plating layer (hereinafter referred to as the "Fe—Ni/Fe—Sn—Ni/Sn layer") having a three-layer structure including an Fe—Ni layer, an Fe—Sn—Ni layer, and a Sn layer, the Fe—Sn—Ni layer and the Sn layer being deposited on the Fe—Sn—Ni layer in that order.

The Sn-containing plating layer may be a continuous layer or a discontinuous layer in a dotted pattern.

The Sn-containing plating layer can be formed by a known process. The Sn-containing plating layer can be formed by the following procedure: for example, electroplating is performed using an ordinary tin phenolsulfonate plating bath, tin methanesulfonate plating bath, or tin halide plating bath such that the mass per unit area of Sn is 2.8 g/m$^2$; a plating layer including an Fe—Sn layer and a Sn layer is formed such that reflowing is performed at a temperature not lower than the melting point of Sn, that is, a temperature of 231.9° C. or higher; cathodic electrolyzing is performed in a 10-15 g/L aqueous solution of sodium carbonate at a current density of 1 to 3 A/dm$^2$ such that an Sn oxide coating formed on the surface by reflowing is removed; and water-washing is then performed.

(2) First Chemical Conversion Coating

The first chemical conversion coating, which contains P and Sn, is disposed on the Sn-containing plating layer. This is because a chemical conversion solution containing tetravalent tin ions and phosphate ions is used, as described below in detail, to efficiently form a chemical conversion coating at a high line speed of 300 m/minute or more as is formed by current chromating. The mass per unit area of P in the chemical conversion coating needs to be 0.3 to 10 mg/m$^2$. This is because when the mass per unit area of P is less than 0.3 mg/m$^2$, the coverage of the coating is insufficient and the effect of preventing the surface oxidation of a tin plating layer is insufficient and because when the mass per unit area thereof is greater than 10 mg/m$^2$, cohesive failure is likely to occur in the chemical conversion coating to cause the deterioration of appearance and/or the reduction of paint adhesion.

The first chemical conversion coating can be formed such that immersion is performed in the chemical conversion solution containing the tetravalent tin ions and the phosphate ions or cathodic electrolyzing is performed in this chemical conversion solution. Water-washing may be performed subsequently to immersion or cathodic electrolyzing. The reason for using the chemical conversion solution containing the tetravalent tin ions and the phosphate ions is to form the chemical conversion coating at a high line speed of 300 m/minute or more as described above. The tetravalent tin ions have high solubility and therefore can be added in a larger amount as compared to bivalent tin ions. The tetravalent tin ions located near the surface of the tin containing plating layer are reduced into bivalent tin ions by electrons emitted in association with the dissolution of a surface portion of the tin plating layer. Therefore, the bivalent tin ions are produced near the surface of the tin plating layer in high concentration, whereby a reaction is promoted. Cathodic electrolyzing promotes reduction of the tetravalent tin ions into bivalent tin ions, promotes reduction of protons, increases the pH near the surface of the tin containing plating layer, and promotes precipitation of insoluble tin secondary phosphate and/or tin tertiary phosphate. Hence, a reaction is further promoted. Thus, the use of the chemical conversion solution containing the tetravalent tin ions and phosphate ions is effective in efficiently forming the chemical conversion coating in a short time.

The chemical conversion solution containing the tetravalent tin ions and the phosphate ions may be an aqueous solution containing 0.5 to 5 g/L of stannic chloride pentahydrate and 1 to 80 g/L of orthophosphoric acid.

(3) Second Chemical Conversion Coating

The second chemical conversion coating, which contains P and Al, is disposed on the first chemical conversion coating. This is because formation of the second chemical conversion coating containing P and Al can suppress the deterioration of appearance and reduction of paint adhesion equally to or better than formation of a conventional chromate coating even if drying is performed at low temperature without performing heating. The reason for this is not clear, but is probably that the presence of Al in the second chemical conversion coating allows formation of a dense phosphate chemical conversion coating having high barrier properties against the oxidation of the tin plating layer, which is disposed thereunder.

The mass per unit area of P and the mass per unit area of Al in the second chemical conversion coating need to be 1.2 to 10 m g/m$^2$ and 0.24 to 8.7 mg/m$^2$, respectively. This is because when the mass per unit area of P is less than 1.2 mg/m$^2$ or the mass per unit area of Al is less than 0.24 mg/m$^2$, the effect of suppressing the surface oxidation of the tin plating layer is insufficient and therefore the deterioration of appearance and reduction of paint adhesion are caused. When the mass per unit area of P is greater than 10 mg/m$^2$, the cohesive failure of the coating occurs and therefore the paint adhesion thereof is likely to be reduced. The upper limit of the mass per unit area of Al is 8.7 mg/m$^2$, which is the maximum stoichiometrically derived from the case where the coating is entirely made of aluminum tertiary phosphate, and does not exceed this value when the mass per unit area of P is less than 10 mg/m$^2$. The mass per unit area of P and that of Al in the chemical conversion coating can be determined by X-ray fluorescence surface analysis.

The second chemical conversion coating can be formed such that immersion is performed in a chemical conversion solution which contains 5 to 200 g/L of aluminum phosphate monobasic and which has a pH of 1.5 to 2.4 or cathodic electrolyzing is performed in this chemical conversion solution and drying is then performed. Immersion or cathodic electrolyzing, water-washing, and drying may be performed in that order. The reason for using the chemical conversion solution which contains 5 to 200 g/L of aluminum phosphate monobasic and which has a pH of 1.5 to 2.4 is as described below. When the concentration of aluminum phosphate monobasic therein is less than 5 g/L, the mass per unit area of Al in the coating is insufficient and therefore high barrier properties against the oxidation of the tin plating layer cannot be obtained. When the concentration thereof is greater than 200 g/L, stability of the chemical conversion solution is low and therefore precipitates are formed in this chemical conversion solution to adhere to the surface of the tinned steel sheet, thereby causing the deterioration of appearance and/or the reduction of paint adhesion.

When the pH of this chemical conversion solution is less than 1.5, it is difficult to deposit the coating and a sufficient mass per unit area cannot be achieved even if the time for the second chemical conversion is significantly increased to several tens of seconds. When the pH thereof is greater than 2.4, it is difficult to control the mass per unit area because the deposition of the coating occurs quickly. Drying is preferably performed at a temperature of lower than 60° C. This is because even if the drying temperature is lower than 60° C., this chemical conversion coating, which is formed by the method, can sufficiently suppress the oxidation of the tin plating layer and therefore any specific heating unit is not necessary. The drying temperature is defined as the ultimate temperature of a sheet.

To allow the mass per unit area of P to reach 1.2 to 10 mg/m$^2$ in a short time, the concentration of aluminum phosphate monobasic is preferably 60 to 120 g/L. To allow the mass per unit area of P to reach 1.2 to 10 mg/m$^2$ at a high line speed, cathodic electrolyzing is more preferable than immersion and the pH of the chemical conversion solution is preferably forcibly increased such that protons located near the interface between the surface of a tin containing plating layer and the chemical conversion solution are consumed by generating gaseous hydrogen by cathodic electrolyzing. To adjust the pH or to increase the reaction rate, this chemical conversion solution may further contain 1 to 20 g/L of orthophosphoric acid.

The pH of the chemical conversion solution can be adjusted by addition of an acid such as phosphoric acid or sulfuric acid or an alkali such as sodium hydroxide. The chemical conversion solution may further contain an accelerator such as $FeCl_2$, $NiCl_2$, $FeSO_4$, $NiSO_4$, sodium chlorate, or a nitrite; an etchant such as a fluorine ion; and a surfactant such as sodium lauryl sulfate or acetylene glycol. The temperature of the chemical conversion solution is preferably adjusted to 70° C. or higher. This is because when the temperature thereof is 70° C. or higher, the rate of deposition increases with an increase in temperature and therefore treatment can be performed at a higher line speed. However, when the temperature thereof is excessively high, the evaporation rate of water from the chemical conversion solution is large and therefore the composition of the chemical conversion solution varies with time. Thus, the temperature of the chemical conversion solution is preferably 85° C. or lower.

In the case of forming a single-layer chemical conversion coating by performing immersion or cathodic electrolyzing in a chemical conversion solution containing tin ions and phosphate ions as disclosed in JP '091, the coating needs to be heated to a temperature of 60° C. to 200° C. subsequently to chemical conversion. For the tinned steel sheet, the second chemical conversion coating is formed on the first chemical conversion coating, which has been formed using the chemical conversion solution containing the tin ions and the phosphate ions such that immersion is performed in the chemical conversion solution containing aluminum phosphate monobasic or cathodic electrolyzing is performed in this chemical conversion solution. Hence, heating need not be performed subsequently to chemical conversion, no heating unit is necessary, and therefore chemical conversion can be performed at low cost.

Since current chromating is usually performed at a line speed of 300 m/minute or more as described above and is extremely high in productivity, novel chemical conversion alternative to chromating can be preferably performed at least the same line speed as that of current chromating. This is because an increase in treatment time requires an increase in the size of a treatment tank and/or an increase in the number of tanks and therefore causes an increase in equipment cost and an increase in maintenance cost. To perform chemical conversion at a line speed of 300 m/minute or more without equipment modification, the treatment time is preferably 2.0 seconds or less as is taken for current chromating and more preferably one second or less. It is possible to cope with a current line speed of 300 m/minute or more by performing immersion or cathodic electrolyzing in the chemical conversion solution. The current density during cathodic electrolyzing is preferably 10 A/dm$^2$ or less. This is because when the current density is greater than 10 A/dm$^2$, the variation range of the mass per unit area is large with respect to the variation of the current density and therefore it is difficult to stably secure the mass per unit area. Processes such as coating and anodic electrolyzing can be used to form the chemical conversion coating in addition to immersion and cathodic electrolyzing. For coating, uneven surface reactions are likely to occur and therefore uniform appearance is unlikely to be obtained. For anodic electrolyzing, a powdery coating is likely to precipitate and therefore the deterioration of appearance and/or paint adhesion is likely to be caused. Thus, these processes are inappropriate.

(4) Silane Coupling Agent-Treating Layer

The presence of the Sn-containing plating layer and the first and second chemical conversion coatings is sufficient to suppress deterioration of paint adhesion. However, to stably secure good paint adhesion for welded beverage cans, two-piece cans, and other cans which are required to have higher paint adhesion, the silane coupling agent-treating layer is provided on the second chemical conversion coating. The mass per unit area of Si in the silane coupling agent-treating layer needs to be 0.10 to 100 mg/m$^2$. This is because the coverage of a silane coupling agent-treating layer is insufficient when the mass per unit area thereof is less than 0.10 $mg/m^2$ and also because the silane coupling agent causes cohesive failure and therefore high paint adhesion cannot be achieved when the mass per unit area thereof is greater than 100 $mg/m^2$. The mass per unit area of Si can be measured by X-ray fluorescence surface analysis.

The silane coupling agent-treating layer may be a continuous layer or a discontinuous layer in a dotted pattern.

The silane coupling agent-treating layer can be formed such that the steel sheet is immersed in a treating solution of the silane coupling agent, that is, for example, an aqueous solution containing 0.1 to 3 mass percent of the silane coupling agent, such as 3-glycidoxypropyltrimethoxysilane, N-2-(aminoethyl)-3-aminopropyltrimethoxysilane, or 3-(2-aminoethyl)-aminopropyltrimethoxysilane, and is then wrung with wringer rollers. In particular, N-2-(aminoethyl)-3-aminopropyltrimethoxysilane and 3-(2-aminoethyl)-aminopropyltrimethoxysilane are preferred because these silanes are excellent in dispersibility, are likely to form treating layers uniformly dispersed on chemical conversion coatings, and have high adhesion to epoxy paints and organic covering layers such as polyester films.

After the silane coupling agent-treating layer is formed, a water film is formed by wringing using the wringer rollers or the like as described above and drying is then preferably performed. Drying is preferably performed at a temperature of 70° C. to 100° C.

EXAMPLES

The following sheets were used as raw materials:

Steel Sheets A that were low-carbon cold-rolled steel sheets with a thickness of 0.2 mm. Steel Sheets B that were low-carbon cold-rolled steel sheets with a thickness of 0.2 mm, both surfaces of the steel sheets were plated with nickel using a Watts bath to have a mass per unit area of 100 $mg/m^2$, and then annealed at 700° C. in an atmosphere containing 10 volume percent $H_2$ and 90 volume percent $N_2$, whereby nickel was diffused.

After Sn layers were formed using a commercially available tin-plating bath such that the mass per unit area of Sn was as shown in Table 4, the Sn layers were reflowed at a temperature not lower than the melting point of Sn, whereby Sn-containing plating layers each including an Fe—Sn layer and a Sn layer were formed on Steel Sheets A and Sn-containing plating layers each including an Fe—Ni layer, an Fe—Ni—Sn layer, and a Sn layer were formed on Steel Sheets B.

To remove surface Sn oxide coatings formed by reflowing, cathodic electrolyzing was performed at a current density of 1 $A/dm^2$ in a 10 g/L aqueous solution of sodium carbonate at a bath temperature of 50° C. After Steel Sheets A and B were washed with water and then immersed in chemical conversion solutions each having an orthophosphoric acid amount, stannic chloride pentahydrate amount, and temperature shown in Tables 1 and 2 or cathodically electrolyzed at a current density for a time as shown in Tables 1 and 2 in the chemical conversion solutions, Steel Sheets A and B were wrung with wringer rollers, were washed with water, and then dried at room temperature using an ordinary blower or at 70° C. with hot air, whereby first chemical conversion coatings and second chemical conversion coatings were formed. The pH of the chemical conversion solutions was adjusted with an acid or an alkali as shown in Tables 1 and 2.

After the chemical conversion coatings were formed, Sample Nos. 1 to 30 were prepared such that Steel Sheets A and B were immersed in the following solutions under conditions shown in Tables 1 and 2, were wrung with wringer rollers, and then dried at 100° C. except some samples such that silane coupling agent-treating layers were formed: Treating Solutions α that were 0.004 to 4.0 mass percent aqueous solutions of N-2-(aminoethyl)-3-aminopropyltrimethoxysilane and Treating Solutions b that were 0.004 to 0.3 mass percent aqueous solutions of 3-(2-aminoethyl)-aminopropyltrimethoxysilane.

After each layer or coating was formed, the mass per unit area of Sn in the Sn-containing plating layers, the mass per unit area of P in the first chemical conversion coatings, the mass per unit area of P in the second chemical conversion coatings, the mass per unit area of Al in the second chemical conversion coatings, and the mass per unit area of Si in the silane coupling agent-treating layers were determined. The tinned steel sheets prepared as described above were evaluated for appearance immediately after preparation, the amount of Sn oxide coatings after long-term storage, appearance after long-term storage, paint adhesion, and corrosion resistance by methods below.

Appearance immediately after preparation: The appearance of each tinned steel sheet was visually observed immediately after preparation and was then evaluated in accordance with standards below. A good appearance was rated as A or B.

A: a good appearance having no surface powdery precipitates and a metallic luster.

B: a good appearance having no surface powdery precipitates and a slightly whitish cast.

C: an uneven appearance having locally present surface powdery precipitates and a slightly whitish cast.

D: a whitish appearance having a large amount of surface powdery precipitates.

Amount of Sn oxide coatings and appearance after long-term storage: Each tinned steel sheet was stored for ten days in an atmosphere having a temperature of 60° C. and a relative humidity of 70%, the appearance thereof was visually observed, the amount of the Sn oxide coatings formed thereon was determined such that the Sn oxide coatings were electrolyzed at a current density of 25 $\mu A/cm^2$ in a 1/1000 N HBr electrolytic solution and the charge required for electrochemical reduction was determined, and the tinned steel sheet was evaluated in accordance with standards below. A tinned steel sheet having a small amount of Sn oxide coatings and good appearance after long-term storage was rated as A or B.

A: a reduction charge of less than 2 $mC/cm^2$ and an excellent appearance (better than a chromated material).

B: a reduction charge of 2 to less than 3 $mC/cm^2$ and a good appearance (substantially equal to a chromated material).

C: a reduction charge of 3 to less than 5 $mC/cm^2$ and a slightly yellowish appearance.

D: a reduction charge of 5 $mC/cm^2$ or more and a clearly yellow appearance.

Paint adhesion: After the tinned steel sheets were coated with an epoxy-phenolic paint immediately after preparation such that the mass per unit area thereof was 50 $mg/dm^2$, the tinned steel sheets were baked at 210° C. for ten minutes. Two of the coated and baked tinned steel sheets were stacked such that a nylon adhesive film is sandwiched between the coated surfaces thereof. After the two tinned steel sheets were laminated under pressing conditions such as a pressure of $2.94\times10^5$ Pa, a temperature of 190° C., and a pressing time of 30 seconds, the laminate was divided into specimens with a width of 5 mm. The specimens were measured for adhesion strength with a tensile tester and were then evaluated in accordance with standards below. A tinned steel sheet with good paint adhesion was rated as A. The tinned steel sheets were stored for six months in a room-temperature atmosphere and were then evaluated for paint adhesion in the same manner as that described above.

A: 19.6 N (2 kgf) or more (substantially equal to a chromated material for welded cans).

B: 3.92 N (0.4 kgf) to less than 19.6 N (substantially equal to a chromated material).

C: 1.96 N (0.2 kgf) to less than 3.92 N.

D: less than 1.96 N (0.2 kgf).

Corrosion resistance: After the tinned steel sheets were coated with an epoxy-phenolic paint such that the mass per unit area thereof was 50 mg/dm$^2$, the tinned steel sheets were baked at 210° C. for ten minutes. The tinned steel sheets were immersed in a commercially available tomato juice at 60° C. for ten days and were then visually evaluated whether a coating was stripped off and rust was present. A tinned steel sheet having good corrosion resistance was rated as A or B.

A: neither stripped coating nor rust.

B: no stripped coating and a slight number of rust spots (substantially equal to a chromated material).

C: no stripped coating and fine rust spots.

D: stripped coating and rust.

The results are shown in Table 4. Sample Nos. 1 to 22 that are the tinned steel sheets each produced by our method each have a good appearance immediately after production and after long-term storage, a small amount of Sn oxide coatings after long-term storage, excellent corrosion resistance, and particularly excellent paint adhesion.

TABLE 1

| | | Conditions for forming first chemical conversion coatings | | | | | Conditions for forming second chemical conversion coatings | | | | | | | | |
|---|---|---|---|---|---|---|---|---|---|---|---|---|---|---|---|
| | | Treating solutions | | | | | Treating solutions | | | | | | | | |
| Sample Nos. | Steel sheets for raw materials | Amount of orthophosphoric acid (g/L) | Amount of stannic chloride pentahydrate (g/L) | Temp. (° C.) | Cathodic electrolyzing (immersion) Current density (A/dm$^2$) | Cathodic electrolyzing (immersion) Time (s) | Amount of orthophosphoric acid (g/L) | Amount of aluminum phosphate monobasic (g/L) | pH | Temp. (° C.) | Cathodic electrolyzing (immersion) Current density (A/dm$^2$) | Cathodic electrolyzing (immersion) Time (s) | Drying System | Drying achieving temperature of the steel sheets (° C.) | Remarks |
| 1 | A | 6.0 | 0.7 | 60 | Immersion | 1.0 | 8.5 | 18.0 | 1.74 | 70 | 4 | 1.0 | Blower | Room temperature | Inventive example |
| 2 | A | 6.0 | 2.7 | 60 | 5 | 1.0 | 4.2 | 18.0 | 1.97 | 70 | 4 | 1.0 | Blower | Room temperature | Inventive example |
| 3 | A | 3.0 | 0.7 | 60 | Immersion | 0.5 | 3.0 | 18.0 | 2.08 | 70 | 4 | 1.0 | Blower | Room temperature | Inventive example |
| 4 | A | 6.0 | 2.7 | 60 | 5 | 1.0 | 3.0 | 54.0 | 2.12 | 80 | 6 | 1.0 | Blower | Room temperature | Inventive example |
| 5 | A | 3.0 | 0.7 | 60 | Immersion | 0.5 | 20.0 | 18.0 | 1.60 | 60 | 4 | 1.0 | Blower | Room temperature | Inventive example |
| 6 | A | 6.0 | 0.7 | 60 | Immersion | 1.0 | 8.5 | 18.0 | 1.74 | 50 | 4 | 1.0 | Blower | Room temperature | Inventive example |
| 7 | A | 3.0 | 0.7 | 60 | Immersion | 0.5 | 8.5 | 60.0 | 1.80 | 50 | 4 | 1.0 | Blower | Room temperature | Inventive example |
| 8 | A | 6.0 | 2.7 | 60 | 3 | 1.0 | 8.5 | 80.0 | 1.80 | 50 | 4 | 1.0 | Blower | Room temperature | Inventive example |
| 9 | A | 6.0 | 2.7 | 60 | 3 | 1.0 | 8.5 | 120.0 | 1.80 | 50 | 4 | 1.0 | Blower | Room temperature | Inventive example |
| 10 | A | 6.0 | 2.7 | 60 | 3 | 1.0 | 8.5 | 200.0 | 1.80 | 50 | 4 | 1.0 | Blower | Room temperature | Inventive example |
| 11 | A | 3.0 | 0.7 | 60 | Immersion | 0.5 | 1.0 | 60.0 | 2.00 | 50 | 4 | 0.5 | Blower | Room temperature | Inventive example |
| 12 | A | 6.0 | 0.7 | 60 | Immersion | 1.0 | 8.5 | 60.0 | 1.80 | 50 | 4 | 1.0 | Hot air | 70 | Inventive example |
| 13 | A | 6.0 | 0.7 | 60 | Immersion | 1.0 | 8.5 | 60.0 | 1.80 | 70 | Immersion | 1.0 | Blower | Room temperature | Inventive example |
| 14 | A | 6.0 | 0.7 | 60 | Immersion | 1.0 | 8.5 | 18.0 | 1.74 | 70 | 5 | 1.0 | Blower | Room temperature | Inventive example |
| 15 | A | 6.0 | 0.7 | 60 | Immersion | 1.0 | 8.5 | 18.0 | 1.74 | 70 | 5 | 1.0 | Blower | Room temperature | Inventive example |
| 16 | A | 3.0 | 0.7 | 60 | Immersion | 0.5 | 8.5 | 18.0 | 1.74 | 70 | 3 | 1.0 | Blower | Room temperature | Inventive example |

TABLE 2

| | | Conditions for forming first chemical conversion coatings | | | | | Conditions for forming second chemical conversion coatings | | | | | | | | |
|---|---|---|---|---|---|---|---|---|---|---|---|---|---|---|---|
| | | Treating solutions | | | | | Treating solutions | | | | | | | | |
| Sample Nos. | Steel sheets for raw materials | Amount of orthophosphoric acid (g/L) | Amount of stannic chloride pentahydrate (g/L) | Temp. (° C.) | Cathodic electrolyzing (immersion) Current density (A/dm$^2$) | Cathodic electrolyzing (immersion) Time (s) | Amount of orthophosphoric acid (g/L) | Amount of aluminum phosphate monobasic (g/L) | pH | Temp. (° C.) | Cathodic electrolyzing (immersion) Current density (A/dm$^2$) | Cathodic electrolyzing (immersion) Time (s) | Drying System | Drying achieving temperature of the steel sheets (° C.) | Remarks |
| 17 | B | 3.0 | 0.7 | 60 | Immersion | 0.5 | 8.5 | 18.0 | 1.74 | 70 | 3 | 1.0 | Blower | Room temperature | Inventive example |
| 18 | A | 3.0 | 0.7 | 60 | Immersion | 0.5 | 8.5 | 18.0 | 1.74 | 70 | 4 | 1.0 | Blower | Room temperature | Inventive example |
| 19 | B | 3.0 | 0.7 | 60 | Immersion | 0.5 | 8.5 | 18.0 | 1.74 | 70 | 4 | 1.0 | Blower | Room temperature | Inventive example |
| 20 | A | 3.0 | 0.7 | 60 | Immersion | 0.5 | 8.5 | 18.0 | 1.74 | 70 | 4 | 1.0 | Blower | Room temperature | Inventive example |
| 21 | B | 6.0 | 2.7 | 60 | 3 | 1.0 | 8.5 | 18.0 | 1.74 | 70 | 4 | 1.0 | Blower | Room temperature | Inventive example |
| 22 | B | 6.0 | 2.7 | 60 | 3 | 1.0 | 8.5 | 18.0 | 1.74 | 70 | 4 | 1.0 | Blower | Room temperature | Inventive example |
| 23 | A | 6.0 | 0.7 | 60 | Immersion | 1.0 | 8.5 | 1.0 | 1.73 | 70 | 4 | 1.0 | Blower | Room temperature | Comparative example |
| 24 | A | 6.0 | 0.7 | 60 | Immersion | 1.0 | 8.5 | 250.0 | 2.00 | 70 | 4 | 2.0 | Blower | Room temperature | Comparative example |
| 25 | A | 6.0 | 0.7 | 60 | Immersion | 1.0 | 8.5 | 60.0 | 1.30 | 85 | 4 | 10.0 | Blower | Room temperature | Comparative example |
| 26 | A | 6.0 | 0.7 | 60 | Immersion | 1.0 | 8.5 | 60.0 | 2.50 | 50 | 4 | 0.5 | Blower | Room temperature | Comparative example |
| 27 | A | 6.0 | 2.7 | 60 | 5 | 1.0 | Not used or performed | | | | | | Blower | Room temperature | Comparative example |
| 28 | B | 6.0 | 0.7 | 60 | Immersion | 1.0 | 8.5 | 18.0 | 1.74 | 70 | 4 | 1.0 | Blower | Room temperature | Comparative example |
| 29 | A | 2.0 | 0.3 | 60 | Immersion | 0.5 | 20.0 | 18.0 | 1.60 | 60 | 4 | 1.0 | Blower | Room temperature | Comparative example |
| 30 | A | 6.0 | 4.0 | 60 | 6 | 5.0 | 8.5 | 18.0 | 1.74 | 70 | 4 | 1.0 | Blower | Room temperature | Comparative example |

TABLE 3

| | Conditions for forming silane coupling agent-treating layers | | |
|---|---|---|---|
| Sample Nos. | Treating solutions | Concentration (mass percent) | Remarks |
| 1 | a | 0.3 | Inventive example |
| 2 | a | 0.3 | Inventive example |
| 3 | a | 0.6 | Inventive example |
| 4 | a | 0.3 | Inventive example |
| 5 | a | 0.3 | Inventive example |
| 6 | a | 0.15 | Inventive example |
| 7 | a | 0.15 | Inventive example |
| 8 | b | 0.3 | Inventive example |
| 9 | b | 0.3 | Inventive example |
| 10 | b | 0.15 | Inventive example |
| 11 | b | 0.1 | Inventive example |
| 12 | a | 0.3 | Inventive example |
| 13 | a | 0.004 | Inventive example |
| 14 | a | 0.3 | Inventive example |
| 15 | a | 0.3 | Inventive example |
| 16 | a | 0.3 | Inventive example |
| 17 | a | 0.3 | Inventive example |

TABLE 3-continued

| | Conditions for forming silane coupling agent-treating layers | | |
|---|---|---|---|
| Sample Nos. | Treating solutions | Concentration (mass percent) | Remarks |
| 18 | b | 0.3 | Inventive example |
| 19 | b | 0.3 | Inventive example |
| 20 | a | 3.0 | Inventive example |
| 21 | a | 0.2 | Inventive example |
| 22 | a | 0.2 | Inventive example |
| 23 | Not used | Not used | Comparative example |
| 24 | a | 0.3 | Comparative example |
| 25 | a | 0.004 | Comparative example |
| 26 | a | 0.3 | Comparative example |
| 27 | b | 0.004 | Comparative example |
| 28 | a | 4.0 | Comparative example |
| 29 | Not used | Not used | Comparative example |
| 30 | Not used | Not used | Comparative example |

TABLE 4

| Sample Nos. | Sn-containing plating layers Mass per unit area of Sn ($g/m^2$) | First chemical conversion coatings Mass per unit area of P ($mg/m^2$) | Second chemical conversion coatings Mass per unit area of P ($mg/m^2$) | Second chemical conversion coatings Mass per unit area of Al ($mg/m^2$) | Silane coupling agent-treating layers Mass per unit area of Si ($mg/m^2$) | Appearance immediately after preparation | Amount of Sn oxide films and appearance after long-term storage | Paint adhesion Immediately after preparation | Paint adhesion After six months | Paint adhesion Corrosion resistance | Remarks |
|---|---|---|---|---|---|---|---|---|---|---|---|
| 1 | 0.8 | 1.00 | 3.20 | 1.70 | 9.0 | A | A | A | A | A | Inventive example |
| 2 | 0.8 | 8.50 | 4.50 | 2.39 | 9.0 | A | A | A | A | A | Inventive example |
| 3 | 0.8 | 0.32 | 6.50 | 3.45 | 18.0 | A | A | A | A | A | Inventive example |
| 4 | 0.8 | 8.50 | 9.50 | 5.13 | 9.0 | B | A | A | A | B | Inventive example |
| 5 | 2.8 | 0.32 | 1.25 | 0.64 | 9.0 | A | A | A | A | A | Inventive example |
| 6 | 0.8 | 1.00 | 2.50 | 1.38 | 4.5 | A | A | A | A | A | Inventive example |
| 7 | 0.8 | 0.32 | 4.50 | 2.43 | 4.5 | A | A | A | A | A | Inventive example |
| 8 | 0.8 | 6.50 | 6.00 | 3.30 | 9.0 | A | A | A | A | A | Inventive example |
| 9 | 0.8 | 6.50 | 7.50 | 4.28 | 9.0 | A | A | A | A | A | Inventive example |
| 10 | 0.8 | 6.50 | 7.60 | 4.41 | 4.5 | A | A | A | A | A | Inventive example |
| 11 | 0.8 | 0.34 | 9.80 | 5.30 | 3.0 | A | A | A | A | A | Inventive example |
| 12 | 0.8 | 1.00 | 4.50 | 2.43 | 9.0 | A | A | A | A | A | Inventive example |
| 13 | 0.8 | 1.00 | 1.80 | 1.40 | 0.1 | A | A | A | A | A | Inventive example |
| 14 | 0.8 | 1.00 | 3.30 | 1.75 | 9.0 | A | A | A | A | A | Inventive example |
| 15 | 0.8 | 1.00 | 3.40 | 1.77 | 9.0 | A | A | A | A | A | Inventive example |
| 16 | 0.1 | 0.32 | 3.60 | 1.94 | 9.0 | A | A | A | A | B | Inventive example |
| 17 | 0.1 | 0.33 | 3.70 | 1.96 | 9.0 | A | A | A | A | B | Inventive example |
| 18 | 1.1 | 0.33 | 3.20 | 1.70 | 9.0 | A | A | A | A | A | Inventive example |
| 19 | 1.1 | 0.32 | 3.30 | 1.75 | 9.0 | A | A | A | A | A | Inventive example |
| 20 | 1.1 | 0.32 | 3.20 | 1.70 | 90.0 | A | A | B | B | A | Inventive example |
| 21 | 1.1 | 6.50 | 3.20 | 1.70 | 6.0 | A | A | A | A | A | Inventive example |
| 22 | 0.1 | 6.50 | 3.60 | 1.91 | 6.0 | A | A | A | A | B | Inventive example |
| 23 | 2.8 | 1.00 | 2.50 | 0.22 | 0 | A | C | B | C | B | Comparative example |
| 24 | 0.8 | 1.00 | 11.00 | 7.59 | 9.0 | D | A | C | C | C | Comparative example |
| 25 | 0.8 | 1.00 | 1.00 | 0.52 | 0.1 | A | C | A | C | C | Comparative example |
| 26 | 0.8 | 1.00 | 12.00 | 6.72 | 9.0 | C | A | C | C | C | Comparative example |
| 27 | 0.8 | 8.50 | 0 | 0 | 0.1 | A | D | B | D | A | Comparative example |
| 28 | 0.8 | 1.00 | 3.20 | 1.70 | 130.0 | A | A | C | C | A | Comparative example |
| 29 | 0.8 | 0.15 | 1.25 | 0.64 | 0 | A | C | B | C | A | Comparative example |
| 30 | 0.8 | 37.50 | 3.20 | 1.70 | 0 | D | A | D | D | D | Comparative example |

Industrial Applicability

The following sheet can thus be produced: a tinned steel sheet which can suppress the deterioration of appearance and reduction of paint adhesion due to surface oxidation of a tin plating layer without using Cr and which can be subjected to chemical conversion at low cost without using a specific heating unit. The tinned steel sheet is suitable for welded beverage cans, two-piece cans, and other cans, which are required to have particularly high paint adhesion. A chemical conversion coating of the tinned steel sheet can be formed at a high line speed of 300 m/minute or more as is formed by current chromating. These can make significant contributions to the industry.

The invention claimed is:

1. A tinned steel sheet comprising:

an Sn-containing plating layer that is substantially free of a tin oxide layer disposed on at least one surface of a steel sheet and in which the mass per unit area of Sn is 0.05 to 20 $g/m^2$;

a first chemical conversion coating disposed directly on the Sn-containing plating layer, which contains P and Sn, and in which the mass per unit area of P is 0.3 to 10 $mg/m^2$;

a second chemical conversion coating disposed on the first chemical conversion coating and contains P and Al, and in which mass per unit area of P is 1.2 to 10 $mg/m^2$ and the mass per unit area of Al is 0.24 to 8.7 $mg/m^2$; and a silane coupling agent-treating layer formed with the silane coupling agent disposed on the second chemical conversion coating and has a mass per unit area of Si of 0.10 to 100 $mg/m^2$.

2. The tinned steel sheet according to claim 1, wherein the silane coupling agent is N-2-(aminoethyl)-3-aminopropyltrimethoxysilane or 3-2-aminoethyl)-aminopropyltri-methoxysilane.

3. A method for producing a tinned steel sheet comprising:

forming an Sn-containing plating layer that is substantially free of a tin oxide layer on at least one surface of a steel sheet such that mass per unit area of Sn is 0.05 to 20 $g/m^2$;

immersing or cathodically electrolyzing the steel sheet in a chemical conversion solution containing tetravalent tin ions and phosphate ions;

immersing or cathodically electrolyzing the steel sheet in a chemical conversion solution which contains 5 to 200 g/L of aluminum phosphate monobasic and which has a pH of 1.5 to 2.4;

drying the steel sheet; and forming a silane coupling agent-treating layer such that mass per unit area of Si is 0.10 to 100 $mg/m^2$.

4. The method according to claim 3, wherein drying is performed at a temperature of lower than 60° C.

5. The method according to claim 3, wherein the silane coupling agent-treating layer is formed using an aqueous solution containing N-2-aminoethyl)-3-aminopropyltrimethoxysilane or 3-(2-aminoethyl)-aminopropyltrimeth -oxysilane.

6. The method according to claim 4, wherein the silane coupling agent-treating layer is formed using an aqueous solution containing N-2(aminoethyl)-3-aminopropyl-trimethoxysilane or 3-(2-aminoethyl)-aminopropyltrimeth-oxysilane.

* * * * *